US005203262A

United States Patent [19]

Menard et al.

[11] Patent Number: 5,203,262

[45] Date of Patent: Apr. 20, 1993

[54] CAN CRUSHING APPARATUS

[76] Inventors: James W. Menard, 515 SE. Sixth St., Abilene, Kans. 67410; Ronnie L. Zachago, 2622 Plantation, Salina, Kans. 67401

[21] Appl. No.: 829,984

[22] Filed: Feb. 3, 1992

[51] Int. Cl.[5] ..... B30B 1/04

[52] U.S. Cl. ..... 100/233; 100/902; 100/293

[58] Field of Search ..... 100/902, 233, 227, 293

[56] References Cited

U.S. PATENT DOCUMENTS

| | | | |
|---|---|---|---|
| 667,581 | 2/1901 | Russell | 100/233 |
| 2,603,270 | 7/1952 | Voigt et al. | 100/293 |
| 2,603,271 | 7/1952 | Heymers | 100/902 |
| 2,638,957 | 5/1953 | Danielson | 100/902 |
| 3,411,722 | 11/1968 | Webber | 100/902 |
| 4,292,891 | 10/1981 | Shelley | 100/902 |
| 4,301,722 | 11/1981 | Balbo et al. | 100/902 |
| 4,442,768 | 4/1984 | Bailey | 100/902 |
| 4,459,905 | 7/1984 | Wilson | 100/902 |
| 4,561,351 | 12/1985 | Ader | 100/233 |
| 5,009,155 | 4/1991 | Christianson | 100/902 |
| 5,048,413 | 9/1991 | Deiters | 100/902 |

FOREIGN PATENT DOCUMENTS

| | | | |
|---|---|---|---|
| 0167100 | 3/1983 | Japan | 100/902 |

OTHER PUBLICATIONS

Taylor Gifts, 40th Anniversary Sale, 1992, p. 17.

*Primary Examiner*—Harvey C. Hornsby
*Assistant Examiner*—Reginald L. Alexander
*Attorney, Agent, or Firm*—Litman, McMahon & Brown

[57] ABSTRACT

A lever-arm can crushing device comprising a base having a disposal opening extending therethrough, a lever arm hingedly secured to the base by a hinge such that the lever arm is movable between an open position and a closed position, a can support surface for supporting a can adjacent the disposal opening before crushing and a can engaging member on the lever arm for engaging the can as the lever arm is advanced from the open position to the closed position. As the lever arm is advanced to the closed position, the engaging member crushes the can and advances the center of gravity of the can from being vertically positioned over the support surface to over the disposal opening such that the can falls through the disposal opening when the lever arm is subsequently advanced to the open position. The can engaging member engages the can on an upper surface thereof on a side of the can upper surface closest the disposal opening. The lever-arm can crushing device is securable to a receptacle for storing the crushed cans.

20 Claims, 2 Drawing Sheets

CAN CRUSHING APPARATUS

BACKGROUND OF THE INVENTION

The present invention relates to a can crushing apparatus and in particular a lever-arm-type crushing device for crushing cans, such as aluminum beverage containers.

Increased environmental awareness along with government sponsored recycling programs have stimulated the recycling of metal containers, particularly extruded aluminum and steel beverage containers. Numerous devices have been developed to crush metal cans to facilitate handling and storage during the recycling process. Lever-arm-type can crushing devices have been found to be particularly well adapted for home or office use where it is practical to crush one can at a time.

In general, the lever-arm-type can crushing devices include a base and a lever arm hingedly connected to the base by a hinge. A can is positioned on the base and the lever arm is advanced towards the base so as to crush the can positioned therebetween. Many recent improvements in lever-arm-type crushing devices have focused on securing the container to be crushed in place relative to the base and the lever arm so that the container is not forced from between the base and lever arm during crushing. In particular the base of such crushing devices typically include support means adapted to support a can in a slightly angled upright alignment wherein the top of the can is angled toward the hinge. The lever arm initially engages a can to be crushed on a side of an upper surface of the can closest the hinge. The lever arm of such crushing devices typically includes means for engaging a rim of the can on a side of the can closest the hinge for preventing the upper portion of the can from being displaced horizontally from beneath the lever arm as the lever arm is subsequently advanced towards the base. When such crushing devices are used to crush a can, the base of the can generally remains stationary and the upper surface of the can is driven downward and horizontally away from the hinge by the lever arm as it is advanced arcuately towards the base such that after crushing the upper surface of the can is generally aligned over the bottom of the can.

After crushing a can with such can crushing devices, typically the user must manually remove or move the crushed can relative to the crushing device and deposit the crushed can in a receptacle. In addition the lever-arm-type can crushing devices typically are designed to be stored separate from the receptacle in which the crushed cans are deposited.

Can crushing devices have been developed that can be secured to a receptacle so as to extend across the receptacle opening and wherein the can automatically falls into the receptacle after it is crushed. In one such device, the base of the device includes an opening smaller than an uncrushed can. The opening is located adjacent a stationary wall. A can to be crushed is laid on its side between the stationary wall and a movable wall such that a portion of the can extends across the opening. The movable wall is connected to a lever arm by a linkage such that when the lever arm is arcuately advanced from a vertical to a horizontal alignment the movable wall is driven horizontally towards the stationary wall so as to crush the can positioned therebetween. The crushed can is smaller than the opening and when the movable wall is subsequently advanced away from the stationary Wall, the crushed can falls through the opening into the receptacle. However, such a device would be unsuitable for many receptacles because the horizontally directed force required to crush the can would cause many receptacles to tip, during the crushing procedure if not held down securely. Also, such a device involves more moving parts and is more difficult to manufacture than standard lever-arm type-can crushing devices as described above.

SUMMARY OF THE INVENTION

The present invention generally comprises a simple yet highly effective lever-arm-type can crushing device including a base having a disposal opening extending therethrough and a lever arm pivotally connected to the base preferably by a hinge. The lever arm is pivotally advanceable between a closed position and an open position. In the closed position, the lever arm extends across the disposal opening. In the open position, the lever arm is angled away from the base. The base further includes support means for supporting a can to be crushed. The can may be positioned on the support means when the lever arm is advanced to the open position. The can is preferably positioned on the support means in an upright vertical alignment so that the center of gravity of the can is located over the support means.

The lever arm includes can engaging means mounted on the lever arm so as to travel along an arcuate path as the lever arm is advanced between the open and closed positions. The can engaging means engages a can supported on the support means when the lever arm is advanced from the open position to a can engaging position. Preferably, the can engaging means initially engages a can on a side of an upper surface of the can closest the disposal opening and furthest away from the hinge. As the lever arm is subsequently advanced toward the closed position the lever arm and can engaging means cooperate to crush and shape the can such that the center of gravity of the can after crushing is positioned over the disposal opening. When the lever arm is subsequently raised to an open position the can falls through the disposal opening.

The initial engagement of the can by the can engaging means on the side of the upper surface of the can closest the disposal opening prevents the can from being urged horizontally out from under the lever arm as the lever arm is advanced to the closed position and causes the can to initially fail on the side closest the disposal opening.

The can crushing device is to be secured to a receptacle having a receptacle opening such that the base of the can crushing device extends across the receptacle opening and the disposal opening in the base is above and communicates with the receptacle opening such that crushed cans are urged by gravity to fall through both openings. The base preferably covers the receptacle opening completely except for the disposal opening. When the lever arm is positioned in the closed position, the lever arm completely closes the disposal opening such that the receptacle opening is covered completely.

The can engaging means is adapted to extend into the can disposal opening when the lever arm is advanced to the closed position allowing the lever arm to abuttingly engage the base. When the lever arm is advanced to the closed position, the can crushing device has a relatively low profile and has the appearance of a cover for the receptacle.

OBJECTS AND ADVANTAGES OF THE INVENTION

Therefore it is an object of this invention to provide a lever arm type can crushing device having a base with a disposal opening extending therethrough and a lever arm pivotally connected to the base at a pivot point, wherein the base is securable to a receptacle so as to extend across a receptacle opening and wherein a can positioned on said base may be crushed and operably caused to fall through the disposal opening and into the receptacle therebelow by advancing the lever arm from an open position to a closed position and back to the open position; to provide such a device wherein the lever arm completely covers the disposal opening when the lever arm is advanced into the closed position; to provide such a device wherein the base completely covers the receptacle opening; to provide such a device having a relatively low profile when the lever arm is positioned in the closed position; to provide such a device having a support means for supporting a can to be crushed in close proximity to the disposal opening between the disposal opening and the pivot point of the lever-arm; to provide such a device wherein the lever arm includes a can engaging member adapted to engage a can to be crushed so as to change the center of gravity of the can as it is being crushed such that the center of gravity is positioned over the disposal opening after the can is crushed; to provide such a device wherein the can engaging member initially engages the can on an upper surface Of the can on a side of the can upper surface opposite of the pivot point of the lever arm; to provide such a device that is relatively easy to manufacture, durable and particularly well adapted for its intended usages.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
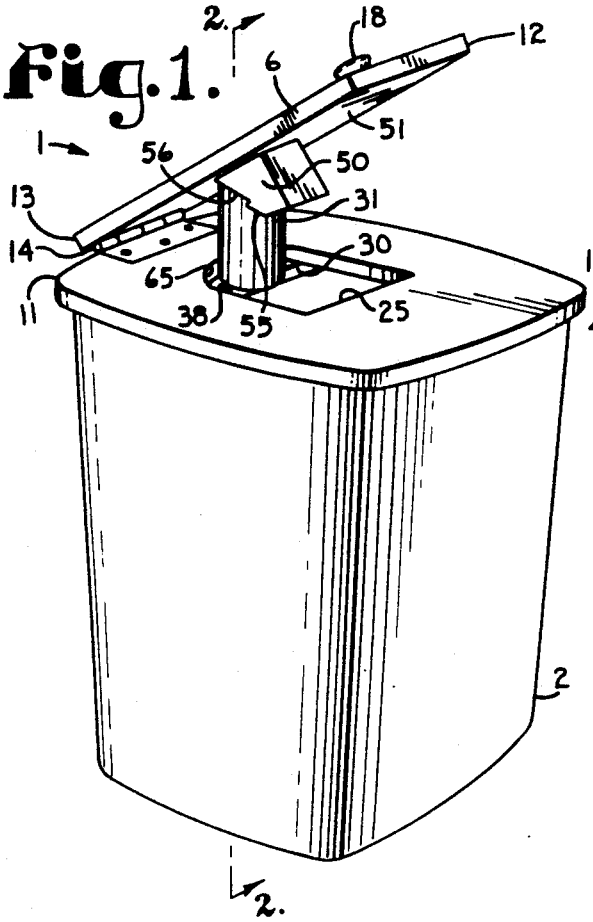
FIG. 1 is a perspective view of a can crushing device of the present invention secured to a receptacle and having a lever arm positioned in a can engaging position wherein the lever arm is engaging a can to be crushed.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail the reference numeral 1 generally refers to a can crushing device of the present invention for use with a receptacle 2 having a receptacle opening 3. The can crushing device 1 comprises a base 5 and a lever arm 6. The base 5 includes a front end 10 and a rear end 11. The lever arm 6 includes a grasping end 12 and a pivot end 13. The pivot end 13 of the lever arm 6 is pivotally or hingedly connected to the rear end 11 of the base 5 by hinge means such as the illustrated hinge 14. The grasping end 12 of the lever arm 6 includes grasping means such as knob 18 graspable by a user for pivotally manipulating the lever arm 6.

The base 5 includes a disposal opening 25 extending therethrough. The disposal opening 25 is generally centrally aligned along a longitudinal axis extending from the rear end 11 to the front end 10 of the base 5 and is spaced closer to the rear end 11 than the front end 10. The can crushing device 1 further includes support means such as shelf 30 for supporting a can 31 to be crushed adjacent to or in close proximity to the disposal opening 25. The shelf 30 is secured to an underside 35 of the base 5 so as to extend across an end of the disposal opening 25 closest to the rear end 11 of the base 5.

The base 5 further includes securement means such as legs or feet 45 which are secured to the underside 35 of the base 5. The feet 45 are spaced on the underside 35 of the base 5 so as to abuttingly engage an inner edge of the receptacle 2 when the base 5 is positioned in covering relationship with the receptacle opening 3 to help prevent slippage of the can crushing device 1 relative to the receptacle 2. It is foreseen that various securement means may be used to secure the base 5 to the receptacle 2. For example, the base 5 may include a peripheral lip adapted to removably engage a lip 47 on the receptacle 2.

The can crushing device 1 further includes can engaging means, such as can engaging member or block 50. The can engaging member 50 is secured to an inner surface 51 of the lever arm 6. The can engaging member 50 includes a lower or initial can engaging surface 55 and an upper or secondary can engaging surface 56.

The lever arm 6 is pivotally advanceable between a closed position and an open position. In the closed position the inner surface 51 of the lever arm 6 planarly engages an upper surface 60 of the base 5 such that the inner surface 51 of the lever arm 6 is flush with the upper surface 60 Of the base 5. Further, when the lever arm 6 is in the closed position the can engaging member 50 extends into and below the disposal opening 25 Of the base 5. In the open position, the lever arm 6 is angled away from the base 5 such that a can 31 may be positioned between the base 5 and the lever arm 6.

With the lever arm 6 in the open position, a can 31 to be crushed is positioned in an upright alignment on the shelf 30 such that the can 31 engages or abuts against a rear wall 65 of the disposal opening 25 and a portion of the can (but not more than one-half) extends beyond the shelf 30 so as to partially extend over the disposal opening 25. The center of gravity of the can 31 positioned on the shelf 30 prior to crushing is vertically positioned above the shelf 30.

Figure 2:
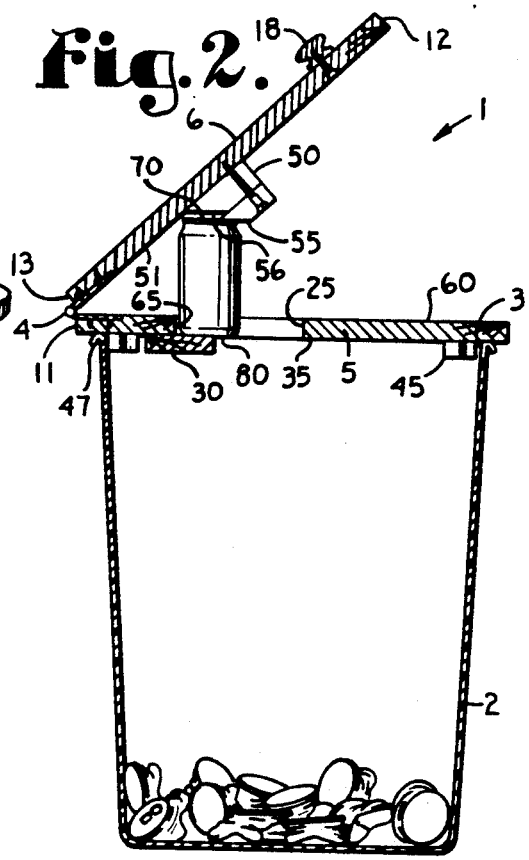
FIG. 2 is a cross sectional view of the can crushing device, taken along line 2—2 of FIG. 1.

After a can 31 is positioned on the shelf 30 in an upright position, the lever arm 6 may be advanced from the open position to a can engaging position (see FIG. 2) wherein the initial can engaging surface 55 of the can engaging member 50 engages an upper surface or lid 70 of the can 31 on a side of the can upper surface 70 positioned furthest away from the hinge 14. The can engaging member 50 is positioned on the lever arm 6 such that when the lever arm 6 is advanced to the initial can engaging position, seen in FIG. 2, the secondary can engaging surface 56 is spaced slightly above the upper surface 70 of the can 31.

To crush the can 31, after the can 31 is positioned on the shelf 30, the user grasps the grasping end 12 of the lever arm 6 and applies a downward force near the grasping end 12 so as to urge the lever arm 6 from the can engaging position towards the closed position. Contact of the upper surface 70 of the can 31 solely by the initial can engaging surface 55 when the lever arm 6 is in the can engaging position concentrates the force applied to the can 31, in advancing the lever arm to the closed position, along the side of the can upper surface 70 closest to the disposal opening 25 and furthest away from the hinge 14. Concentration of the applied force on a single side of the can 31 reduces the force necessary to cause the can 31 to initially fail or buckle as compared to the application of the force uniformly across the upper surface 70 of the can 31.

Figure 3:
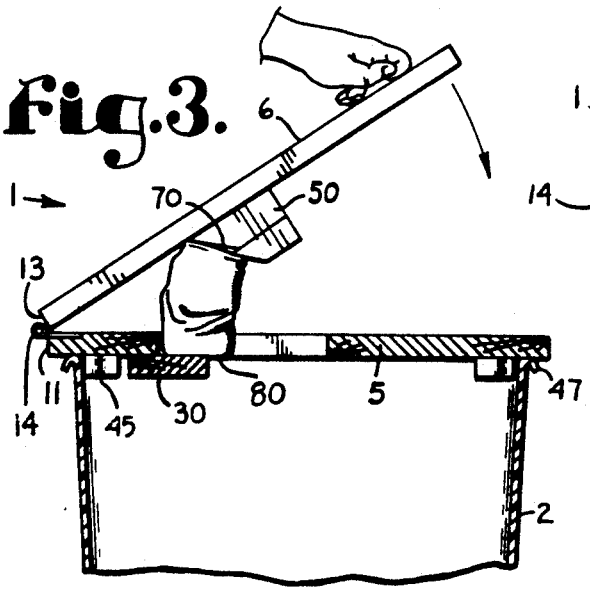
FIG. 3 is a fragmentary view of the can crushing device, similar to FIG. 2 showing the lever arm being advanced toward a closed position.
Figure 4:
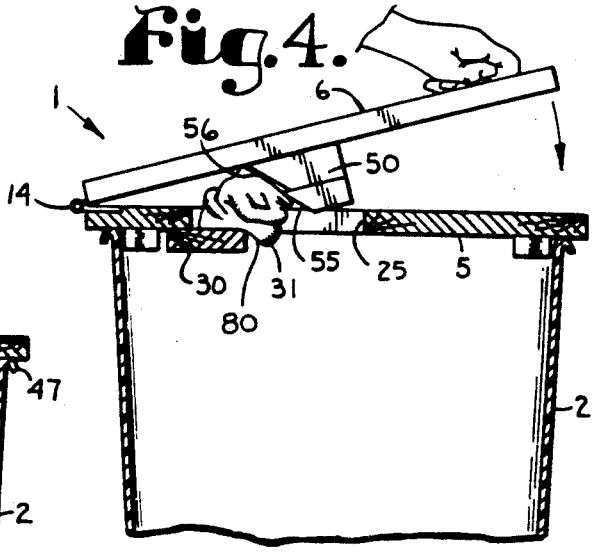
FIG. 4 is a fragmentary view of the can crushing device, similar to FIG. 2 showing the lever arm being advanced toward the closed position.

Concentrating the initial applied force on the side of the can upper surface 70 closest to the disposal opening 25 and furthest away from the hinge 14 also prevents the can 31 from being displaced horizontally from between the lever arm 6 and the base 5 as the lever arm 6 is advanced to the closed position. As the lever arm 6 is advanced to the closed position (FIGS. 3 through 5), the concentration of the applied force on the side of the can upper surface 70 closest to the disposal opening causes the side of the can upper surface 70 closest the disposal opening 25 to bend or buckle downwards relative to the remainder of the can such that a portion of the can upper surface 70 is engaged by the secondary can engaging surface 56 and a rear edge of the can upper surface 70 is engaged by the inner surface 51 of the lever arm 6 generally adjacent the can engaging member 50.

Figure 5:
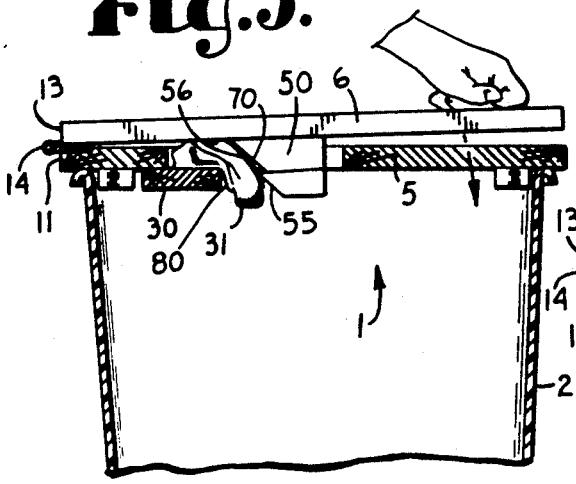
FIG. 5 is a fragmentary view of the can crushing device, similar to FIG. 2 showing the lever arm being advanced toward the closed position producing a crushed can.

The can engaging member 50 is advanced along an arcuate path as the lever arm 6 is advanced between the open position and the closed position. The arcuate path traveled by the can engaging member 50 as the lever arm 6 is pivotally advanced toward the closed position applies a downward or compressive force and a horizontal or sheer force on the can 31 positioned on the shelf 30. The downward force generally compresses the can 31 while the horizontal or sheer force causes the center of gravity of the can 31 to advance from being vertically positioned over the shelf 30 to being vertically positioned in or over the disposal opening 25, as the lever arm 6 is advanced so as to become close to the closed position (as is seen in FIG. 5). The arcuate path traveled by the can engaging means reduces the likelihood of tipping the receptacle 2 during the crushing procedure by reducing the horizontal component of the applied force in relation to the downward component.

As the lever arm 6 is advanced to the closed position the can upper surface 70, engaged by the can engaging member 50 and the inner surface 51 of the lever arm 6, is forced or urged downward toward the shelf 30 and the disposal opening 25 and horizontally away from the shelf 30 and toward and over the disposal opening 25. A bottom surface 80 of the can 31 generally remains in a fixed position on the shelf 30 as the lever arm 6 is advanced to the closed position. However, the bottom surface 80 of the can may be horizontally advanced slightly towards the disposal opening 25 during crushing. After the can 31 is crushed, the can upper surface 70 preferably extends completely over the disposal opening 25 and at least a portion of the bottom surface 80 of the can 31 remains positioned on or in contact with the shelf 30. During crushing, the can upper surface 70 is horizontally displaced out of vertical alignment with the can bottom surface 80.

Figure 6:
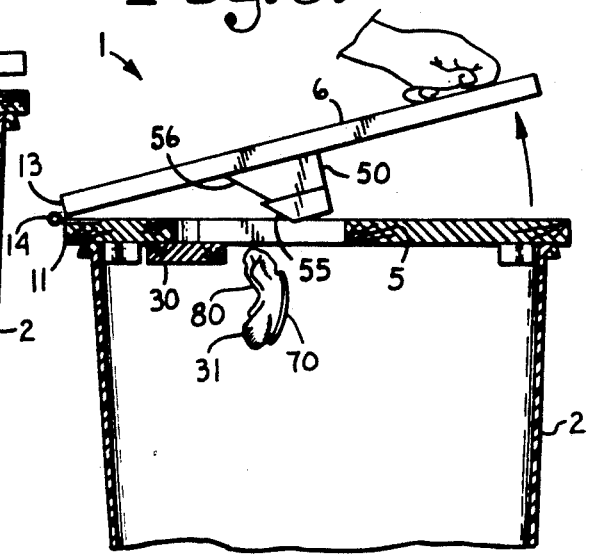
FIG. 6 is a fragmentary view of the can crushing device, similar to FIG. 2 showing the lever being advanced toward an open position after being in the closed position causing the crushed can to fall into the receptacle.
Figure 8:
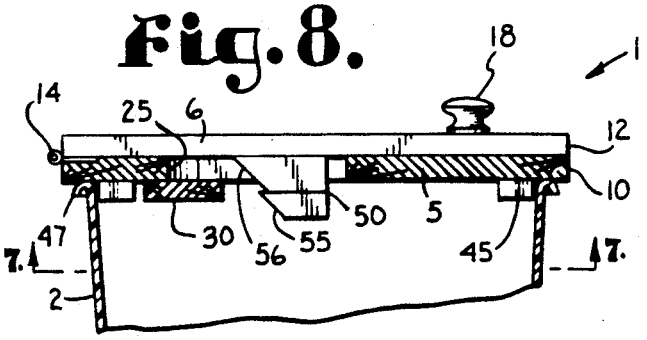
FIG. 8 is a fragmentary view of the can crusher, similar to FIG. 2 showing the lever arm in a fully closed position
Figure 7:
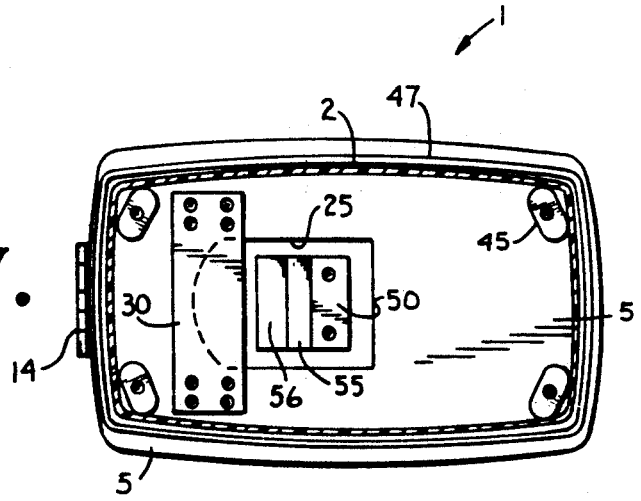
FIG. 7 is a bottom plan view of the can crushing device.

After the can 31 is crushed, the lever arm 6 is raised such that the can 31 having a center of gravity positioned over the disposal opening 5 falls through the disposal opening 25, through the receptacle opening 3 and into the receptacle 2 without the need for additional manual or mechanical intervention (see FIG. 6).

The rear wall 65 of the disposal opening 25 functions as positioning means for guiding the positioning of a can 31 to be crushed on the shelf 30. The rear wall 65 also tends to prevent the bottom surface 80 or lower portion of the can 31 from being urged rearward towards the hinge 14 during crushing. It is foreseen that the crushing device 1 of the present invention may be constructed without the shelf 30 and a can 31 to be crushed would simply be positioned on an upper surface 60 of the base 5 between the disposal opening 25 and the hinge 14 such that a portion of the can 31 (no more than half) extends over the disposal opening 25.

When the lever arm 6 is advanced to the closed position, the can engaging member 50 extends within and through the disposal opening 25 such that the inner surface 51 of the lever arm 6 may lie generally completely flush with the upper surface 60 of the base 5 such that the can crushing device 1 has a relatively low profile. Concealment of the can engaging member 50 when the lever arm 6 is in the closed position gives the can crushing device 1 the appearance of a cover for the receptacle 2.

The can crushing device 1 is preferably made of lightweight strong and rigid material such as wood, plastics, rubber or lightweight metals.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for crushing cans comprising:

(a) a base having a disposal opening extending therethrough;

(b) a lever arm pivotally connected at a pivot end of said lever arm to said base and pivotally movable between a closed position wherein said lever arm extends across said disposal opening and an open position wherein said lever arm is angled relative to said base;

(c) support means attached to said base for positioning and supporting a can to be crushed on said base when said lever arm is in said open position such that the center of gravity of the can is vertically positioned over said support means so that the can is supported by said support means; and (d) a can engaging surface mounted on said lever arm such that said can engaging surface travels along an arcuate path as said lever arm is advanced between said open position and said closed position; said lever arm being advanceable from said open position to a can engaging position wherein said can engaging surface is adapted to engage the can such that as said lever arm is subsequently advanced towards said closed position; the traveling of said can engaging surface along an arcuate path causes the can to be crushed in such a manner that the center of gravity of the can after crushing is positioned over said disposal opening.

2. The apparatus for crushing cans as disclosed in claim 1 wherein:

(a) said base is adapted to be positioned on a receptacle having a receptacle opening such that the base is vertically positioned above the receptacle opening and the disposal opening communicates with the receptacle opening.

3. The apparatus for crushing cans as disclosed in claim 2 including:

(a) the receptacle; and wherein:

(b) said base extends completely across the receptacle opening.

4. The apparatus for crushing cans as disclosed in claim 1 wherein:

(a) said support means is sized and positioned so as to support a can to be crushed in an upright position.

5. The apparatus for crushing cans as disclosed in claim 1 further comprising:

(a) grasping means on said lever arm for facilitating grasping of said lever arm by a user.

6. The apparatus for crushing cans as disclosed in claim 1 wherein:

(a) said can engaging surface extends into and through said disposal opening when said lever arm is positioned in said closed position.

7. A can crushing device adapted for use with a receptacle having a receptacle opening; said can crushing device comprising:

(a) a base adapted to be positioned on the receptacle to cover the receptacle opening; said base having a disposal opening extending therethrough, and, when positioned on the receptacle, said disposal opening is located above and in communication with the receptacle opening;

(b) a lever arm pivotally connected at a pivot end of said lever arm to said base and pivotally movable between a closed position wherein said lever arm engages said base along a substantial length thereof and extends across said disposal opening and an open position wherein said lever arm is connected near said pivot end thereof to said base and a remainder of said lever arm is angled away from said base;

(c) a can support surface on said base extending from said disposal opening toward said pivot end of said lever arm; said support surface adapted to receive a can thereon when said lever arm is in said open position such that the can is supported by said support surface and is positioned in close proximity to said disposal opening so that the center of gravity of the can is positioned vertically above said can support surface; and (d) a can engaging structure secured to said lever arm; said lever arm being movable between said open position and a can engaging position wherein said can engaging structure is adapted to engage an upper surface of a can positioned on said can support surface; said can engaging structure being shaped and positioned so as to be adapted to engage a can upper surface on a side of the can upper surface furthest away from said pivot end of said lever arm when said lever arm is in said can engaging position; said lever arm being movable between said can engaging position and said closed position so as to be adapted to crush a can in such a manner that after crushing the center of gravity of the can is vertically positioned over said disposal opening and when said lever arm is subsequently moved towards said open position the can falls through said disposal opening.

8. The apparatus for crushing cans as disclosed in claim 7 in combination with said receptacle.

9. The apparatus for crushing cans as disclosed in claim 7 wherein:

(a) said can support surface being shaped and sized so as to be adapted to support a can to be crushed in an upright position.

10. The apparatus for crushing cans as disclosed in claim 7 including:

(a) grasping means on said lever arm for facilitating grasping of said lever arm by a user.

11. The apparatus for crushing cans as disclosed in claim 7 including:

(a) securement means for removably securing said base to said receptacle.

12. The apparatus for crushing cans as disclosed in claim 11 wherein said securement means comprises:

(a) a plurality of legs secured to an underside of said base so as to be adapted to abuttingly engage an inner surface of the receptacle when said base is positioned in covering relationship with the receptacle opening.

13. The apparatus for crushing cans as disclosed in claim 7 wherein:

(a) said can engaging structure is generally positioned within and through said disposal opening when said lever arm is positioned in said closed position such that said lever arm assumes a low profile relative to said base when in said closed position.

14. An apparatus for crushing cans comprising:

(a) a base adapted to be positioned on a receptacle having a receptacle opening such that said base covers the receptacle opening; said base having a disposal opening extending therethrough adapted to be positioned over and communicate with said receptacle opening;

(b) a lever arm pivotally connected at a pivot end of said lever arm to said base and pivotally movable between a closed position wherein said lever arm engages said base along a substantial length of said lever arm and covers said disposal opening and an open position wherein the lever arm is angled relative to said base;

(c) a can support shelf secured to an underside of said base and extending across a portion of said disposal opening closest to the pivot end of the lever arm; and (d) a can engaging structure secured to said lever arm and including an initial can engaging surface and a secondary can engaging surface;

(e) said lever arm being movable between said open position and a can engaging position wherein said initial can engaging surface is adapted to engage an upper surface of a can positioned on said can support shelf; said initial can engaging surface including can engaging means that are sized and positioned to be adapted to engage the can on a side of the can upper surface furthest away from said pivot end of said lever arm such that when a downward force is applied to said lever arm by a user to advance said lever arm from said can engaging position towards said closed position said initial can engaging surface is adapted to initially concentrate the force along the side of the can upper surface furthest away from said pivot end of said lever arm and as said lever arm is further advanced towards said closed position said initial can engaging surface and said secondary can engaging surface cooperate to crush the can in such a manner that the center of gravity of the can after crushing is positioned over said disposal opening such that when said lever arm is subsequently advanced to said open position the can falls through said disposal opening into said receptacle.

15. The apparatus for crushing cans as disclosed in claim 14 in combination with said receptacle.

16. The apparatus for crushing cans as disclosed in claim 14 wherein:

(a) said can support surface is shaped and positioned to support a can to be crushed in an upright position.

17. The apparatus for crushing cans as disclosed in claim 14 including:

(a) grasping means on said lever arm for facilitating grasping of said lever arm by a user.

18. The apparatus for crushing cans as disclosed in claim 14 including:

(a) securement means for removably securing said base to the receptacle.

19. The apparatus for crushing cans as disclosed in claim 18 wherein said securement means comprises:

(a) a plurality of legs secured to an underside of said base so as to be adapted to abuttingly engage an inner surface of said receptacle when said base is positioned in covering relationship with the receptacle opening.

20. The apparatus for crushing cans as disclosed in claim 14 wherein:

(a) said can engaging structure extends completely within and through said disposal opening when said lever arm is positioned in said closed position.

* * * * *